US005338941A

United States Patent [19]

Sappok

[11] Patent Number: 5,338,941

[45] Date of Patent: Aug. 16, 1994

[54] RADIATION SHIELDING TRANSPORT CONTAINER FOR IRRADIATED NUCLEAR REACTOR FUEL ELEMENTS AND METHOD OF APPLYING SEALING COATING TO SAME

[75] Inventor: Manfred Sappok, Tönisvorst, Fed. Rep. of Germany

[73] Assignee: Siempelkamp Giesserel GmbH & Co., Krefeld, Fed. Rep. of Germany

[21] Appl. No.: 9,460

[22] Filed: Jan. 27, 1993

[30] Foreign Application Priority Data

Feb. 15, 1992 [DE] Fed. Rep. of Germany ..... 4204527

[51] Int. Cl.[5] ..... G21F 5/00

[52] U.S. Cl. ..... 250/506.1; 250/496.1

[58] Field of Search ..... 250/506.1, 515.1, 496.1

[56] References Cited

U.S. PATENT DOCUMENTS 4,288,698 9/1981 Baatz et al. ..... 250/518.1

4,596,688 6/1986 Popp ..... 250/506.1

*Primary Examiner*—Paul M. Dzierzynski

*Assistant Examiner*—Kiet T. Nguyen

*Attorney, Agent, or Firm*—Herbert Dubno

[57] ABSTRACT

Spherulitic cast iron container bodies for radiation shielding containers for irradiated fuel elements are provided with sealing coatings which prevent the body from acting as a galvanic element in a water basin during the filling of the container with the irradiated fuel elements. The coating of nickel, nickel based alloys or chromium/nickel austenitic alloys is applied by applying particles of a diameter less than the diameters of open pores of the body surfaces to these surfaces and then fusing the particles together and to the substrate with a laser beam, preferably in a back and forth motion. The pores are thus filled with the particle melt layer.

8 Claims, 3 Drawing Sheets

RADIATION SHIELDING TRANSPORT CONTAINER FOR IRRADIATED NUCLEAR REACTOR FUEL ELEMENTS AND METHOD OF APPLYING SEALING COATING TO SAME

FIELD OF THE INVENTION

My present invention relates to a shielding container for transporting and storing nuclear reactor fuel elements and to a method of applying a sealing coating to same. More particularly, the invention relates to a container which is capable of including nuclear reactor fuel elements which have been removed from a nuclear reactor core in such manner as to minimize the transmission of radiation from the irradiated fuel element. The invention also relates to the coating which can be applied to such a container for sealing purposes so as to minimize the absorption of water, for example, and, in general, to seal pores of the walls of such a container.

BACKGROUND OF THE INVENTION

It is known to provide containers, into which a cover can be recessed at the top thereof, of spherulitic cast iron which can have surfaces with open pores and which are formed by casting, to accommodate nuclear materials for storage and transport to disposal sites, or to hold irradiated fuel elements until they can be processed.

It is also known that the porosity of the cast iron can pose a problem and hence it has been proposed to coat the cast iron with a metal in an effort to seal the pores thereof. The sealing layer can be applied to the seat receiving the cover or to the cover as well.

In the past, radiation shielding transport containers of this type have been used to accommodate irradiated fuel elements by immersion of the container in the fuel element basin of the nuclear reactor which generally is filled with water and the fuel elements are introduced into the container under water. The basin has usually a cladding of stainless steel, for example 18/8 chromium nickel steel.

For electrochemical reasons, upon introduction of the container of cast iron into such a basin, the container will form a galvanic element and especially ferritic iron will be lost from the cast matrix into the solution. As a consequence, the stainless steel cladding of the fuel element basin will be corroded and the surface of the cast iron container will be detrimentally affected.

To avoid this problem, it has been proposed to provide a sealing layer on the surfaces of the container which will come into contact with the water. This hinders the formation of the container as a galvanic element and solubilization of ferritic iron from the cast iron structure and also, therefore, reduces the corrosive effects. By and large in the past nickel and nickel alloys have served as coatings for the cast iron for this purpose.

The coating has been applied to the cast iron structure by galvanic techniques, i.e. electroplating. For this purpose, galvanotechnical apparatus must be used and because of the large size of the containers employed, galvanotechnical apparatus for coating the containers are highly expensive.

From a practical point of view, it has been found that electroplating techniques can be used effectively only for very thin layers so that layers of 200 micrometers or greater in thickness cannot readily be grown on such cast iron surfaces.

Because of unavoidable mechanical, thermal or corrosive effects, it has been found that claddings applied galvanotechnically to the cast iron structures have more or less point-form open locations or defects.

Investigations which have not become part of the published literature have shown that these open locations tend to form above open pores which are present in the surface of the cast body. Apparently these defects in the coating are unavoidable because the open pores, by reason of the electrical potential at and around the pores during electroplating, cause gaps in the electrodeposited coating at least initially so that the pores are not filled with the nickel or nickel-based alloy, but rather appear to be bridged by relatively thin and mechanically sensitive layers.

The areas at which the pores are located are those bridged by a coating which does not penetrate into the pores and is mechanically sensitive at these locations so that even minimal stresses can break away the coating, even if the coating is extremely thick, for example of a thickness of 1.5 mm, 2.0 mm or more, to expose the pores and create incipient defects in the coating.

Without such thick coatings, moreover, bridging of the pores cannot be ensured so that earlier coating techniques are not very reliable and are very expensive.

OBJECTS OF THE INVENTION

It is, therefore, the principal object of the present invention to provide an improved radiation shielding transport container of the above-described type and for the above-described purpose, capable of receiving the irradiated fuel elements in a water basin which, however, is free from the drawbacks outlined above.

Another object of the invention is to provide an improved spherulitic cast iron container of the aforedescribed type, whose coating can be composed of nickel, nickel-based alloys, austenitic chromium/nickel alloys, but without the sensitivity to mechanical stresses described above.

Still another object of my invention is to provide an improved method of making such a cast iron container which will be free from earlier disadvantages.

Still another object is to provide a method of coating a spherulitic cast iron container which will ensure filling all pits in the surface of the cast iron with the nickel-containing material.

SUMMARY OF THE INVENTION

These objects and others which will become apparent hereinafter are attained, in accordance with the invention with a radiation shielding container of the spherulitic cast iron type in which a cover or lid can be recessed and in which the surface or each surface of the spherulitic cast iron adapted to come into contact with water in the water basin for filling with the irradiation or spent fuel elements or otherwise, is provided with a coating of a metal or metal alloy from the group which consists of nickel, nickel-based alloys and austenitic chromium/nickel alloys, wherein the sealing layer has the texture and structure of a layer hardened from a particle melt formed from particles of a diameter which is smaller than that of the open pores of the spherulitic cast iron structure and wherein the layer also fills open pores.

When reference is made to a texture and structure of a solidified powder melt, I intend to thus describe a layer formed from particles or droplets of metal of diameters smaller than the pore diameter of the spherulitic cast iron which are fused together into a substantially continuous sealing layer and which, in addition, are fused to the spherulitic cast iron, but wherein the particles or droplets need not have been so fully coalesced that they lose all of the boundaries of the original droplets or particles, i.e. the particle melt need not form a completely continuous and homogeneous liquid film.

According to the invention, therefore, the hardened layer can correspond to a powder melt, i.e. a layer formed from powder. The texture can also correspond to a droplet melt, i.e. the layer can be structured as fine droplets which fuse together and to the substrate, i.e. the spherulitic cast iron.

The layer is primarily applied to the exterior of the container to prevent the container from forming a galvanic element in the water-filled basin. It may, however, also be applied to the internal surfaces of the container and to the seat for the cover.

The melting of the particles to form the layer which has the aforedescribed texture can be effected in a conventional manner utilizing modern metal coating techniques.

The invention is based upon my discovery that a sealing layer having the texture of a layer solidified from a particle melt surprisingly is able to readily fill the open pores of the cast body when the particles have a diameter which is smaller than that of the open pores. It will be apparent that the diameter of the particles must be sufficiently small for this purpose. The particular diameter of the particles used can be readily determined from a simple inspection of the surface porosity of the cast iron body and by simple tests.

Since the open pores of the cast body are completely filled by the sealing layer of the invention, the above-described problems with respect to radiation shielding transport containers no longer arise, i.e. the sealing layer is no longer sensitive to mechanical disruption which will expose the pores because the latter are only bridged by galvanically applied layers. As a consequence, very thin sealing layers can be used and, according to the invention, the sealing layer can have a thickness up to 200 micrometers and preferably of a thickness of about 100 micrometers.

According to a feature of the invention, the cast body of the container is mechanically treated to promote adhesion of the sealing layer and the mechanically treated surface can receive the layer directly. The mechanical treatment can include a grinding, polishing, wire brushing, sandblasting, shot peening or the like. The mechanical treatment appears to tear away spherical graphite inclusions in the cast iron matrix at least along the surface.

It is indeed surprising, moreover, that the sealing layer can be applied to a surface of the cast body which has been merely cleaned, by, for example, a simple degreasing operation. Here as well the surface of the cast body has uniform fine pores which are filled by the powder melt coating.

For application of the sealing layer, as has already been noted, a variety of coating techniques utilized in metal coating technology can be employed. I prefer to effect the coating by a laser coating process.

According to a feature of the invention, the particles applied to the surface are fused together to form the particle melt and are fused to the substrate by a laser beam. Preferably the laser beam is played back and forth across the surface in overlapping or adjacent strips after the particles have been applied to the surface, thereby fusing the particles together and causing them to bond to the substrate. The particles can be applied as a powder spray through a powder spray nozzle. The particles can also be applied by the plasma spray technique.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 3:
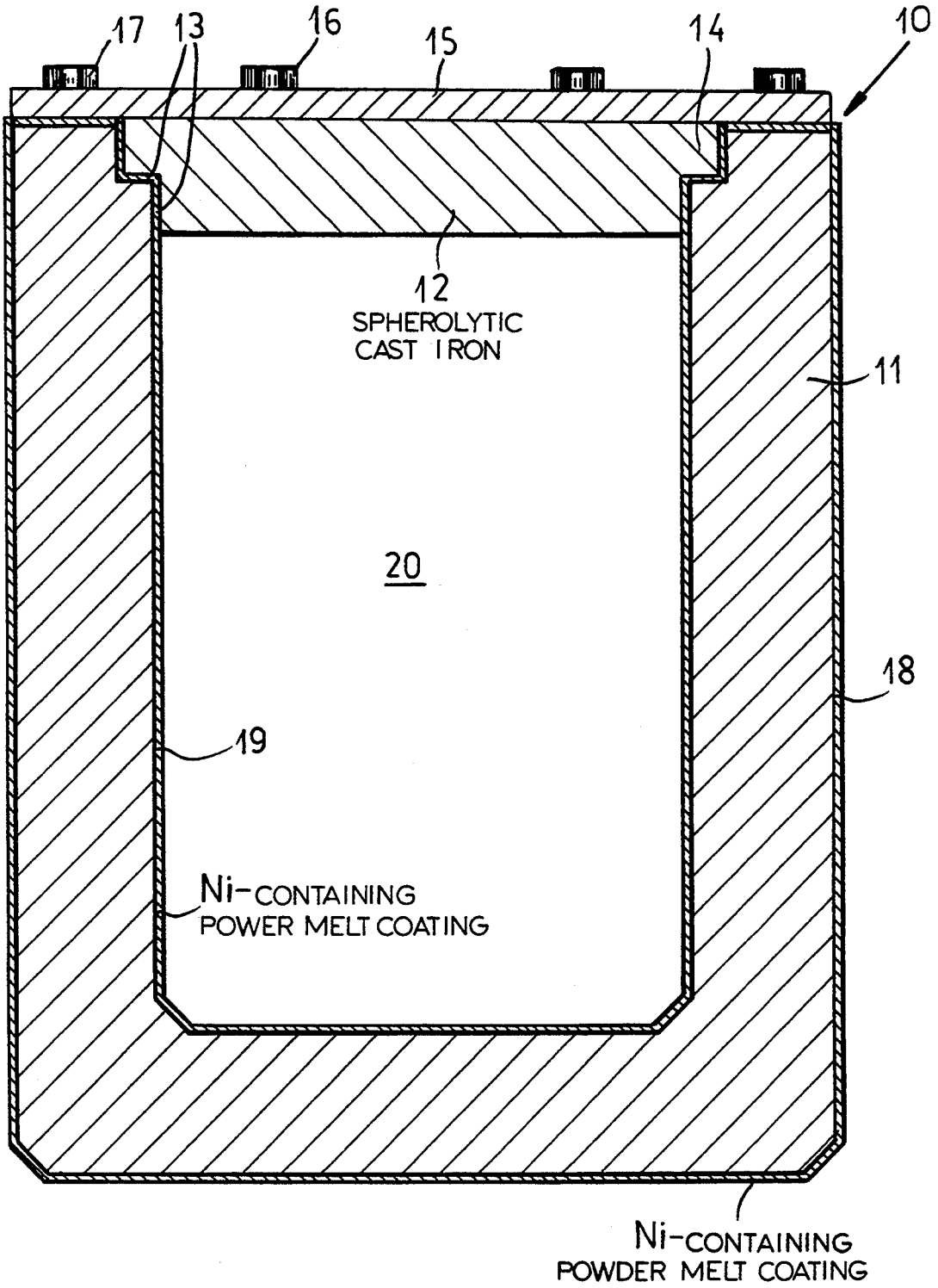
FIG. 3 is a cross sectional view through a radiation shielding container, according to the invention, provided with the coating shown in FIG. 2.

Referring first to FIG. 3, it can be seen that a radiation shielding container for receiving spent fuel elements of a nuclear reactor, especially for transport, but also for storage and adapted to be filled in a water basin as previously described, is represented at 10 and comprises a spherulitic cast iron body 11 whose outer surface is provided with a sealing coating 18 of a powder melt and consisting of nickel or a nickel-based alloy, including chromium/nickel 18-8 austenitic alloy. A similar coating, referred to as a powder melt coating can be provided at 19 at the interior of the container defining the space 20 receiving the irradiated fuel elements. The coating can be applied to the seats 13 in which the stepped shoulders 14 of the spherulitic cast iron cover 12 can be received.

The entire container can be closed by a lid 15 which is attached by bolts 16 to the cover 12 and bolts 17 to the container body.

Figure 1:
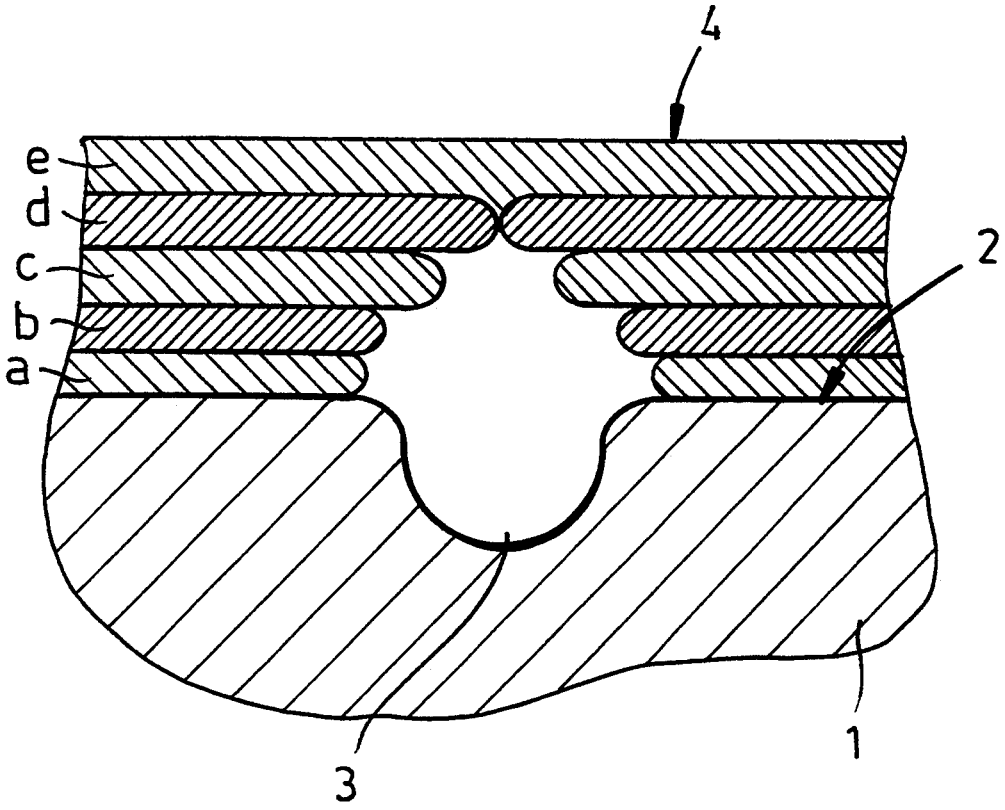
FIG.1 PRIOR ART
FIG. 1 is a highly enlarged diagrammatic cross sectional view showing a prior art galvanic or electroplating technique for applying a coating to a spherulitic cast iron substrate, illustrating a problem with the prior art systems.

FIG. 1 shows a cast body 1 having a surface 2 provided with open pores 3. On this surface a sealing layer 4 is applied to nickel or nickel-based alloy. As can be seen in FIG. 1, the coating 4 is applied galvanically, i.e. by electroplating techniques. It must be applied in a multiplicity of layers a, b, c, d and e in order to bridge the open pores 3. Not only is the open pore 3 not filled, but because of the potential characteristics in the region of the pore during the electrodeposition process, the coating 4 contains a cavity in the region of the pore which is only closed by a thin layer of the coating although the overall thickness of the layer is considerable. As a consequence, the coating is sensitive to mechanical disruption which can cause breakthrough to that cavity and expose the open pore to the action of water.

The effectiveness of this type of coating in preventing the container from forming a galvanic element in a water basin during filling with the irradiated fuel elements, therefore, is limited.

Figure 2:
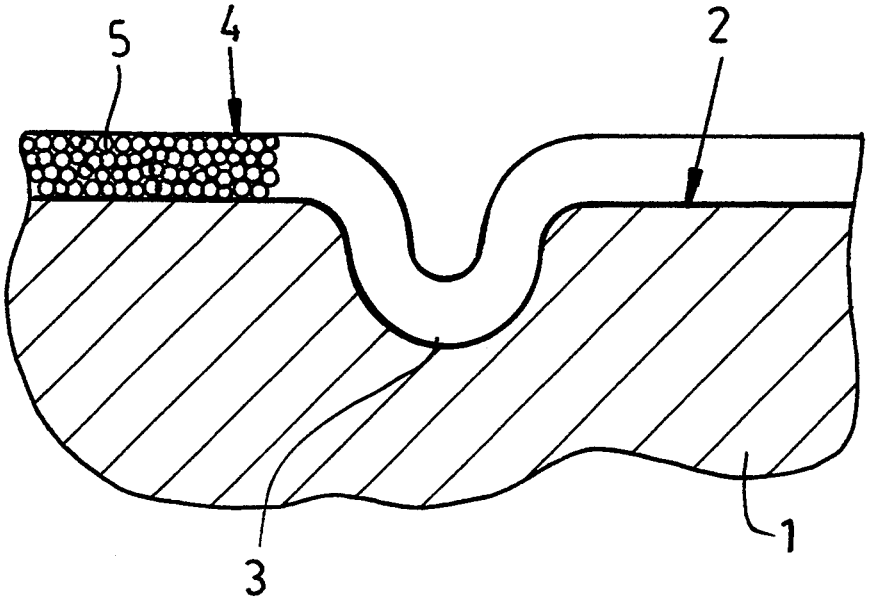
FIG. 2 is a cross sectional view, also greatly enlarged and highly diagrammatic in nature illustrating principles of the present invention.

By contrast, as can be seen in FIG. 2, when the sealing layer 4 has a texture 5 of a layer solidified from a particle melt in which the particles have diameters substantially smaller than the diameters of the pores, the layer fills the pore 3 and the overall layer thickness can be substantially smaller.

The layer thickness for example, may be of the order of 100 micrometers and the particle size can be of the order of 1 to 10 micrometers.

The system has been found to be highly advantageous for spherulitic cast irons having the following compositions: 3.2 to 3.8% by weight carbon, 1.6 to 2.6% by weight silicon, 0.1 to 0.3% manganese, 0.025 to 0.06% by weight magnesium, the balance being iron and the usual elements unavoidably present in spherulitic cast irons.

The preferred composition of the powder is 99 or more percent by weight nickel and phosphorous and other elements commonly present with nickel, and high purity nickel can be present here as well.

Figure 4:
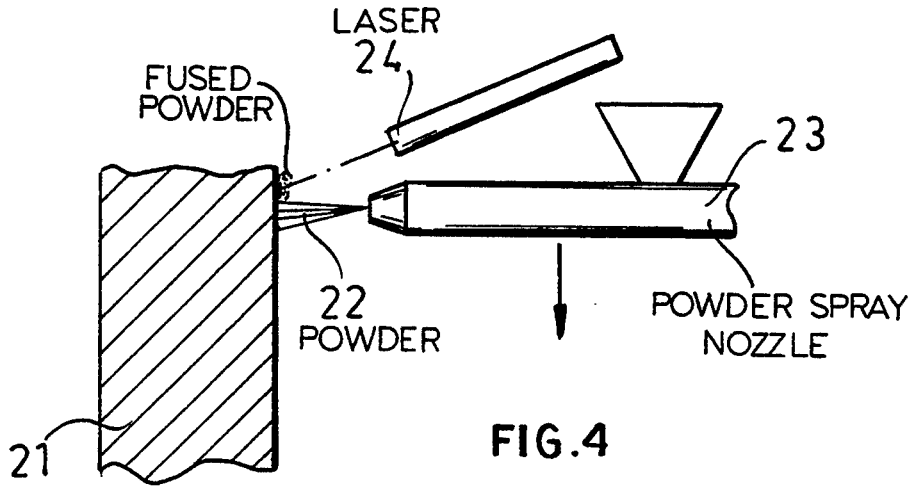
FIG. 4 is a diagrammatic section illustrating application of the coating.

As can be seen from FIG. 4, the spherulitic cast iron substrate 21 can be coated with powder 22 from a powder spray nozzle and a laser beam played back and forth across the powder coated surface as represented by the laser 24 to fuse the particles together and to the substrate.

Figure 5:
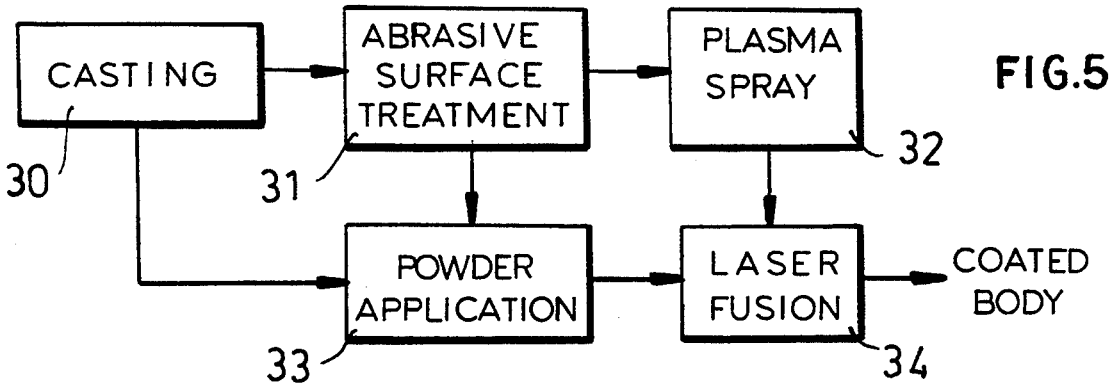
FIG. 5 is a block diagram describing the steps in the process.

In principle, therefore, following casting of the body in an initial step at 30, represented in FIG. 5, the body of the container can be subjected to an abrasive surface treatment at 31 by shot peening or the like and can then be coated with the powder or droplets by plasma spray 32 or coated with the powder as described in connection with FIG. 4 in a separate application 33 followed by a laser fusion in a successive step 34.

Figure 6:
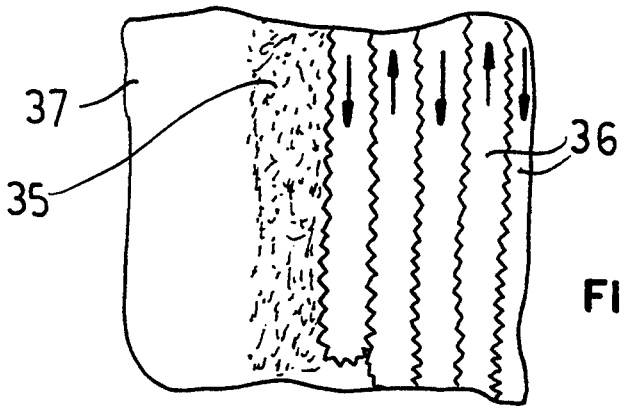
FIG. 6 is an elevational view showing the laser treatment of the surface in strips.

FIG. 6 shows the path of the laser beam 36 on the powder coated surface 35 of the substrate 37, i.e. the back and forth or reciprocating path previously mentioned.

I claim:

1. A method of making a radiation shielding container for irradiated nuclear-reactor fuel elements, comprising the steps of:

(a) casting a spherulitic cast iron container body to form surfaces, said container body having a recessed seat for a cover and a cover is received in said seat, said surfaces having open pores in the cast iron;

(b) coating said surfaces with particles of a metal or metal alloy selected from the group which consists of nickel, nickel-based alloys, and austenitic nickel/chromium stainless steels and of a particle size smaller in diameter than the diameter of said pores, thereby filling said pores with said particles; and (c) applying a laser beam upon said particles and said surfaces to at least partially fuse said particles to form a particle melt and bond said particles together and to said surfaces.

2. The method defined in claim 1 wherein said surfaces are coated with said particles in the form of a layer of powder producing a powder melt upon applying of the laser beam thereon to partially fuse said particles.

3. The method defined in claim 1 wherein said surfaces are coated with said particles in the form of a layer of powder producing a droplet melt upon applying of the laser beam thereon to partially fuse said particles.

4. The method defined in claim 1 wherein said particles are applied to said surfaces in at least one layer of a thickness up to about 200 micrometers.

5. The method defined in claim 4 wherein said layer is applied to said surface in a thickness of about 100 micrometers.

6. The method defined in claim 1 further comprising the step of mechanically abrading the surfaces before the coating thereof with said particles.

7. The method defined in claim 1 wherein said laser beam is applied on said surfaces with a back and forth movement fusing said particles to said surfaces.

8. The method defined in claim 7 wherein said particles are applied to said surfaces with a powder spray.

* * * * *